US006199813B1

(12) United States Patent
Oliva

(10) Patent No.: US 6,199,813 B1
(45) Date of Patent: Mar. 13, 2001

(54) CEILING FIXTURE DECORATION ASSEMBLY

(76) Inventor: Tuan Oliva, 3822 B Shea, Tierra Santa CC, Weslaco, TX (US) 78596

( * ) Notice: Subject to any disclaimer, the term of this patent is extended or adjusted under 35 U.S.C. 154(b) by 0 days.

(21) Appl. No.: 09/334,442

(22) Filed: Jun. 16, 1999

(51) Int. Cl.[7] ..... B42F 13/00
(52) U.S. Cl. ..... 248/343; 248/342; 248/344
(58) Field of Search ..... 248/342, 343, 248/344; 416/5, 244 R, 246, 170 R; 362/96

(56) References Cited

U.S. PATENT DOCUMENTS

| | | | | |
|---|---|---|---|---|
| Re. 34,147 | * | 12/1992 | Rezek | 416/5 |
| 1,042,881 | * | 10/1912 | Bowen | 416/5 |
| 1,687,166 | * | 10/1928 | Little | 416/5 |
| 5,151,011 | * | 9/1992 | Rezek | 416/5 |
| 5,439,352 | | 8/1995 | Line | 416/170 R |
| 5,836,740 | | 11/1998 | Wang | 416/5 |

* cited by examiner

*Primary Examiner*—Leslie A. Braun
*Assistant Examiner*—A. Joseph Wujciak
(74) *Attorney, Agent, or Firm*—McHale & Slavin

(57) ABSTRACT

A fixture decoration assembly for changing the appearance of a selected ceiling-mounted fixture employs a first elongated sleeve portion and a second elongated sleeve portion. The first and second sleeve portions each has an arcuate cross-section and a contoured outer surface. Bracing panels extend from the interior surface of each sleeve portion and cooperatively maintain the suspension member included with the selected ceiling-mounted fixture in a fixed position with respect to the sleeve portions. In an alternate embodiment, the bracing panels are supplemented with compressible material is disposed between the sleeve portions to surround and brace a flexible suspension member included with the selected ceiling-mounted fixture. The exterior of each sleeve is contoured and includes at least one cutting guide that facilitates shortening of the sleeve portions to standard, predetermined lengths. A post-and-aperture arrangement prevents unwanted vertical shifting of the sleeve portions, and a tongue-and-groove arrangement prevents lateral shifting between the sleeve portions. In a preferred embodiment, the first ends of the sleeve portions cooperatively form a cavity sized and shaped to conceal the ceiling canopy associated with a selected ceiling fixture.

7 Claims, 3 Drawing Sheets

CEILING FIXTURE DECORATION ASSEMBLY

FIELD OF THE INVENTION

This invention is directed to ceiling fixtures and, in particular, to a ceiling fixture decoration assembly.

BACKGROUND OF THE INVENTION

Ceiling fixtures can quickly change the appearance of a room, often providing a space-saving combination of beauty and utility. Ceiling-mounted paddle fans, for example, help keep a room cool or warm by increasing air circulation. Ceiling fan use can also save space and increase safety by eliminating the need for floor fans. Suspended light sources, such as chandeliers and pendant lights, provide room lighting that supplements or replaces lamps and other light sources.

Broadly speaking, ceiling-mounted fixtures typically include three components: a fixture main assembly, a ceiling canopy that covers the mounting hardware and electrical junction box, and a suspension member that extends between the main assembly and the ceiling canopy. The three components are often sold as a complete set.

This multi-component design is easy to ship and produce. However, the ceiling canopy and suspension member provided with a given fixture does not always suit the fixture main assembly.

In many cases, an individual will purchase a ceiling fan or light based upon the appearance of the fixture main assembly, without the ability to select the accompanying ceiling canopy and suspension member. As a result, it is quite possible that a purchased fixture will include mounting components that do not match a chosen fan or light. At other times, otherwise-acceptable mounting components may simply not match the decor of a given room. For these and other reasons, it is often desirable to change the appearance of the mounting components included with a given ceiling fixture.

Unfortunately, changing the appearance of ceiling fixture mounting components can be difficult. Replacement components may, for example, not be available for antique or one-of-a-kind fixtures. And even where suitable replacement components are available, actually replacing the components may often prove difficult or costly. As an alternative to component replacement, several devices have been developed to allow an individual to cover selected mounting hardware.

U.S. Pat. No. 5,439,352, for example, discloses a decorative casing device for a ceiling fan. The '352 device includes a main body and a decorative casing member. Support arms on the main body engage the casing member and hold the casing member in place with respect to an existing ceiling fan.

Although the casing member covers the selected fan motor, the '352 device does not modify the appearance of the remaining fixture components.

U.S. Pat. No. 5,836,740 discloses an outer casing for mounting around a ceiling fixture suspension rod. The '740 device includes cooperating side, top, and bottom panels that are assembled to form a sealing vessel that surrounds a fixture suspension rod . Each of the panels has teeth that engage corresponding notches in the adjacent panels. While the '740 casing covers some suspension members, the device has a fixed size and is, therefore, suitable only in limited situations. Additionally, the '740 device does not change the appearance of ceiling canopies or ceiling mounting hardware.

Thus, what is needed is a decoration device for ceiling-mounted fixtures that includes advantages of the known devices, while addressing the shortcomings they exhibit. The device should change the appearance of suspension members as well as ceiling canopies, if desired. The device should also be modifiable to fit fixture support components of various lengths. Additionally, the device should be installed and removed without tools. The device should also positively engage components that are to be covered, thereby preventing unwanted relative shifting between the device and concealed components.

SUMMARY OF THE INVENTION

The instant invention is a ceiling fixture decoration assembly for changing the appearance of the ceiling canopy and suspension member associated with ceiling-mounted fixtures, such as lights and fans. The present invention includes elongated sleeve portions that cooperate to form a cylindrical cover sized and shaped to selectively enclose the suspension member and ceiling canopy of a given ceiling fixture.

Each included sleeve portion is characterized by a contoured exterior surface and has a flared first end spaced apart from a second end by a middle region. The contoured exterior of each sleeve includes integrated guides that facilitate cutting the sleeves to one of several standard lengths, if desired. The guides are incorporated into the design of the contoured exterior and do not detract from the appearance of the device if unused. As a result, the guides provide an unobtrusive means by which the device may be customized for use in a variety of settings.

A series of resiliently-compressible fastening posts extends from contact edges of the first sleeve portion to releasably engage corresponding fastening post apertures disposed along the contact edges of the second sleeve portion. In this manner, the sleeve portions may be selectively secured together in a use orientation and separated apart, for storage, without the need for tools.

A collection of bracing panels extends orthogonally from the exterior surface of the sleeve portions. During use, the bracing panels prevent unwanted relative shifting between the sleeve portions and the surrounded suspension member. The present invention may be used with flexible suspension members, such as cables and chains. When used to conceal a flexible suspension member, compressible material is used to supplement the bracing panels, thereby increasing the amount of contact between the present invention and the suspension member.

Thus an objective of the instant invention is to provide a decoration device for ceiling-mounted fixtures that changes the appearance of suspension members as well as ceiling canopies, if desired.

An additional objective of the instant invention is to provide a decoration device for ceiling-mounted fixtures that is modifiable to fit fixture suspension members of various lengths.

Yet another objective of the instant invention is to provide a decoration device for ceiling-mounted fixtures that can be installed and removed without tools.

A further objective of the instant invention is to provide a decoration device for ceiling-mounted fixtures that positively engages components that are to be concealed, thereby preventing unwanted relative shifting between the device and covered components.

Other objects and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objects and features thereof.

DETAILED DESCRIPTION OF THE PREFERRED EMBODIMENT

Figure 1:
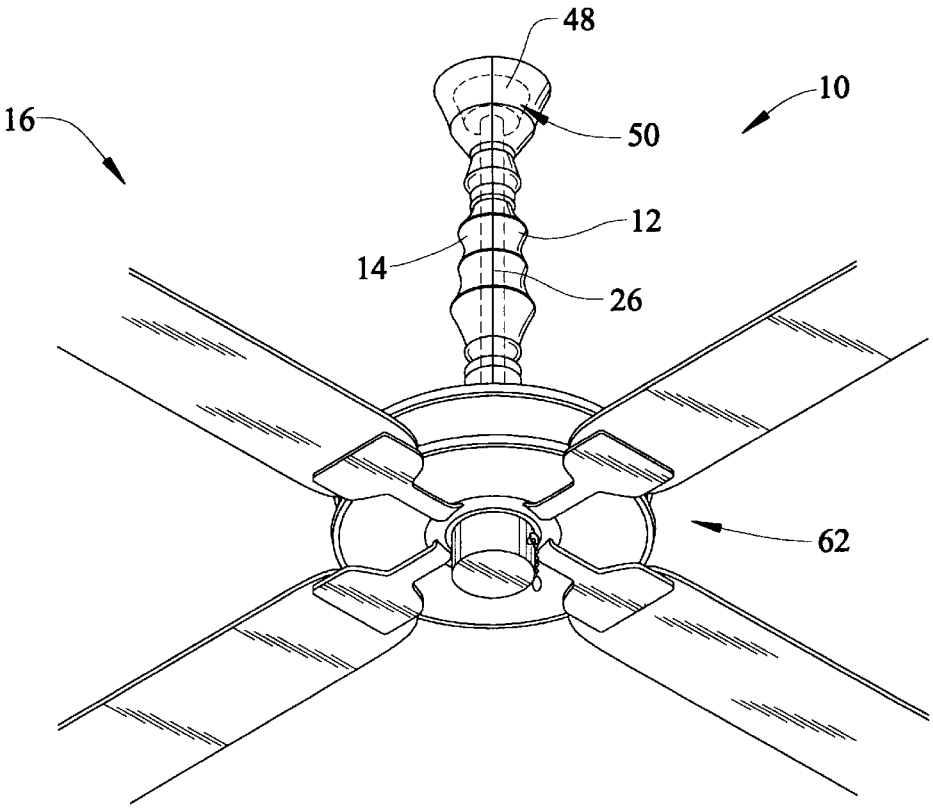
FIG. 1 is a pictorial view of the fixture decoration assembly of the present invention in use.

It is to be understood that while a certain form of the invention is illustrated, it is not to be limited to the specific form or arrangement of parts herein described and shown. It will be apparent to those skilled in the art that various changes may be made without departing from the scope of the invention and the invention is not to be considered limited to what is shown in the drawings and described in the specification.

Now with reference to FIG. 1, the fixture decoration assembly 10 of the present invention is shown in use. By way of overview, the decoration assembly 10 includes a first elongated sleeve portion 12 that cooperatively engages a second elongated sleeve portion 14 to encircle selected portions of a ceiling-mounted fixture 16. As will be described more fully below, the exterior 18,20 of each sleeve portion 12,14 is characterized by contours, including guides 22 that facilitate cutting of the sleeves 12,14 to consistent, predetermined lengths. Included bracing panels 24 extend orthogonally from the sleeve portion interior surfaces 31,33 and cooperatively steady the sleeve portions 12,14 against a fixture suspension member 26 during use. Resiliently-compressible fastening posts 28 extending from contact edges 30 of the first sleeve portion 12 and engage corresponding post apertures 32 disposed along contact edges 35 of the second sleeve portion 14. With the resiliently-compressible fastening posts 28 inserted into the post apertures 32, the sleeve portions 12,14 remain releasably joined together. The details of the present invention 10 will now be discussed.

Figure 2A:
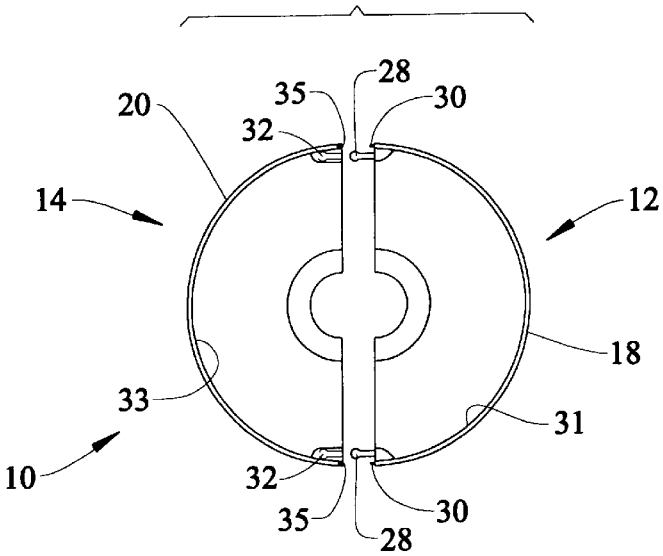
FIG. 2A is a top plan elevation view of the fixture decoration assembly shown in FIG. 2.
Figure 2:
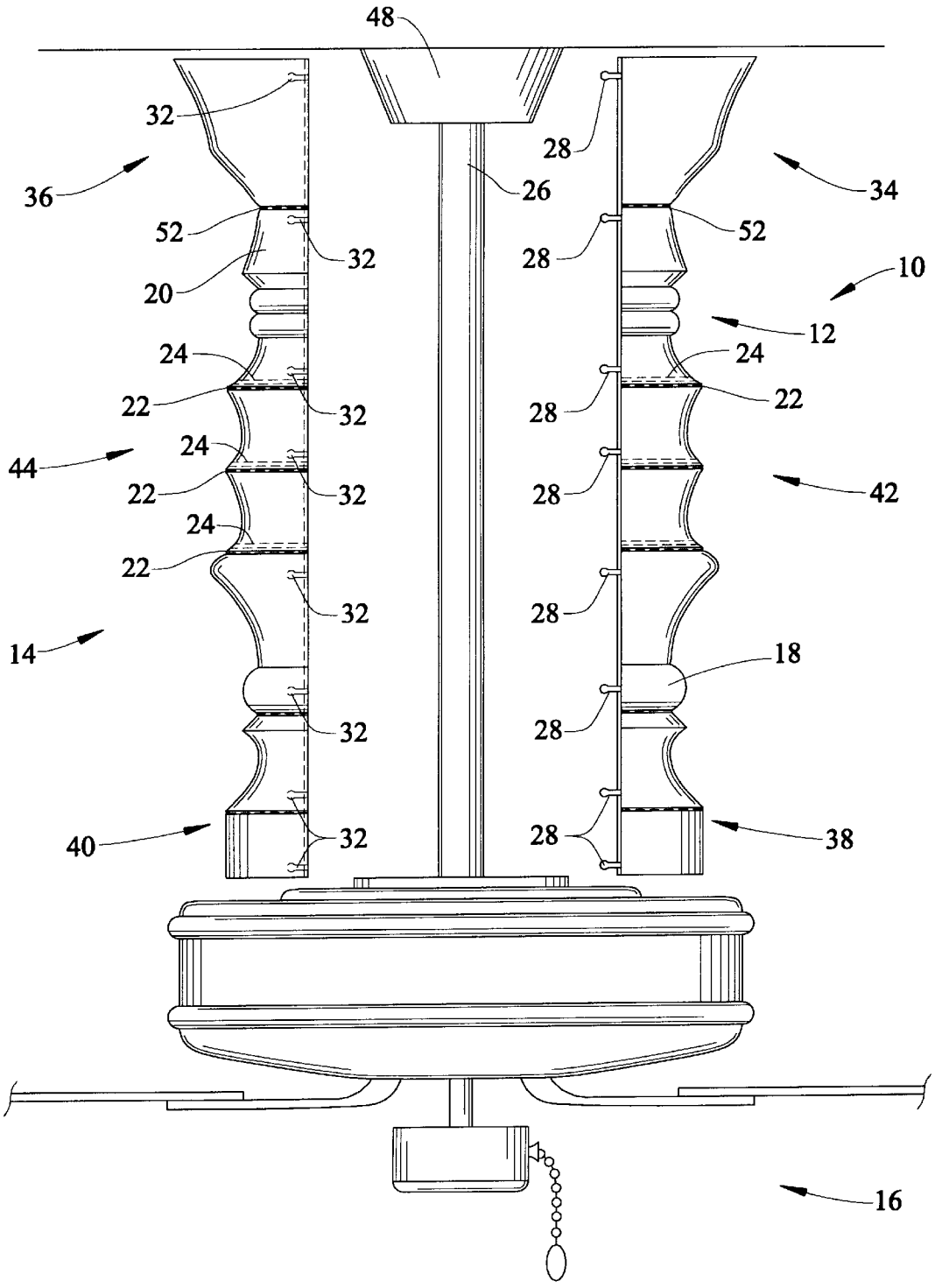
FIG. 2 is a side elevation view of the fixture decoration assembly shown in FIG. 1.

With continued reference to FIG. 1, and with additional reference to FIG. 2, each sleeve portion 12,14 of the present invention resembles an elongated shell having an interior surface 31,33 and a contoured exterior surface 18,20. Additionally, each sleeve portion 12,14 is characterized by a first end 34,36 spaced apart from a second end 38,40 by a middle portion 42,44. Although many shapes will suffice, the sleeve portions 12,14 each preferredly has a substantially arc-shaped cross section, as seen in FIG. 2A.

With continued reference to FIG. 2A, the contact edges 30,35 of each sleeve portion 12,14 meet in a tongue-and-groove arrangement to prevent lateral shifting of the sleeve portions during use. Resiliently-compressible fastening posts 28 also help secure the sleeve portions 12,14 with respect each other. More particularly, the fastening posts 28 prevent unwanted vertical shifting between the sleeve portions 12,14. With reference to FIGS. 2 and 2A, the fastening posts 28 extend from the contact edges 30 of the first sleeve portion 12 and engage post apertures 32 associated with the contact edges 35 of the second sleeve portion 12. Each of post apertures 32 is sized and shaped to releasably secure a corresponding fastening post 28. This arrangement prevents relative vertical shifting of the sleeve portions 12,14, while also preventing unwanted separation thereof.

Figure 3:
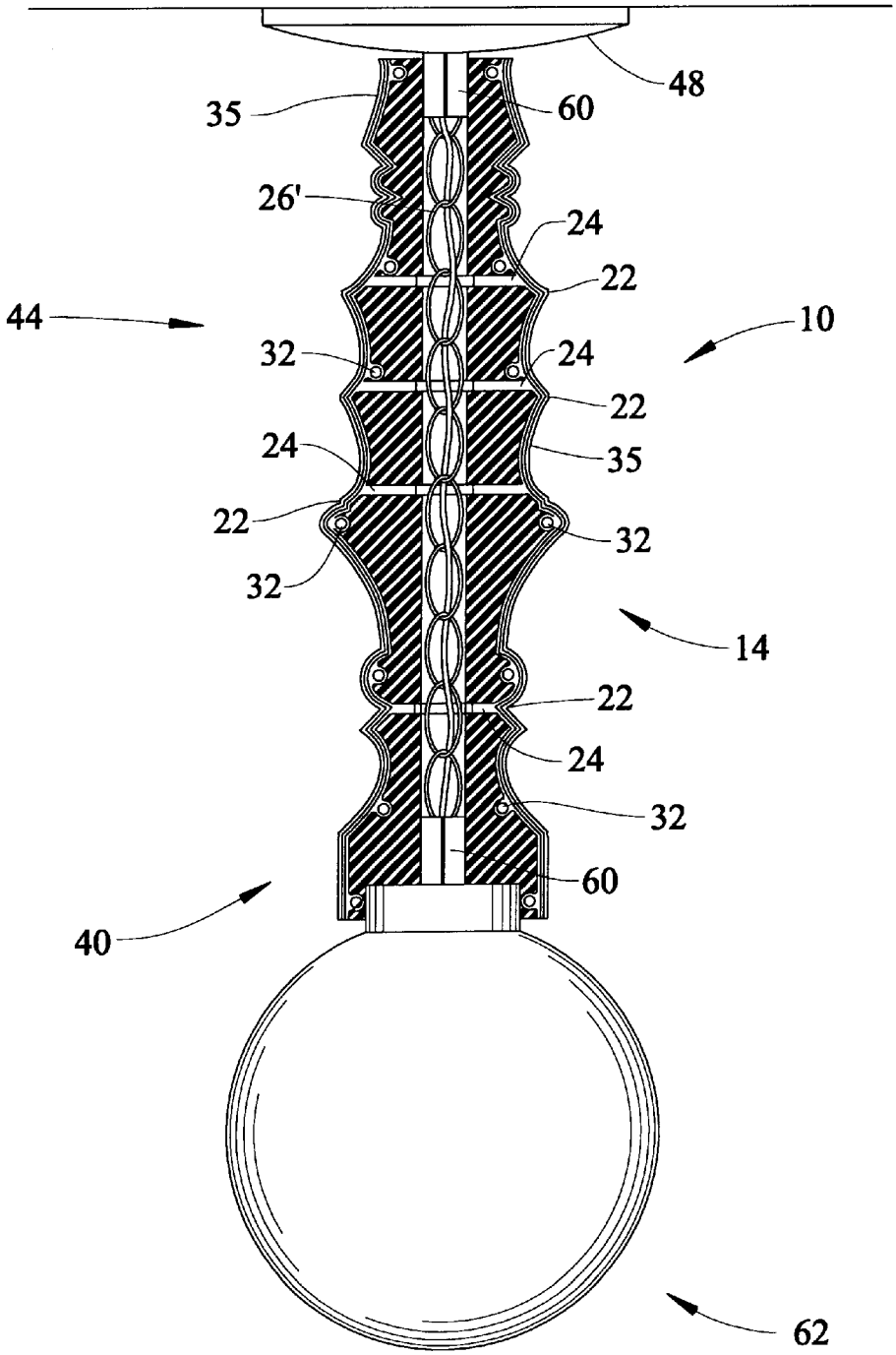
FIG. 3 is a side elevation view of the second sleeve portion of the fixture decoration assembly shown in FIG. 1, with the first end removed and compressible material inserted to steady a flexible suspension member.

In a preferred embodiment, the first end 34,36 of each sleeve portion 12,14 is flared so that the first ends cooperatively form a concealment cavity 50 sized to encompass an existing ceiling canopy 48, as shown in FIG. 1. However, in keeping with the customizable nature of the present invention, the fixture decoration assembly 10 may be used with the concealment cavity 50 removed, as shown in FIG. 3. To facilitate removal of concealment cavity 50, the sleeve portions 12,14 each include a concealment cavity cutting guide 52, as seen in FIG. 2. The concealment cavity cutting guides 52 ensure uniform cutting away of the associated sleeve flared first ends 34,36. Separating the flared first ends 34,36 from the sleeve middle portions 42,44 along the concealment cavity cutting guides 52 ensures that the sleeve portions 12,14 will be of equal length, thereby engaging an existing ceiling mount assembly 48 in a desired manner. It is noted that the sleeve portions 12,14 may be cut without cutting guide use. However, cutting along the guides 22,52 helps produce predictable results.

To ensure stable installation and use, a series of bracing panels 24 extends from the interior surface 31,33 of each sleeve portion 12,14. The bracing panels 24 advantageously reduce unwanted shifting between the suspension member 26 and the sleeve portions 12,14. When the present invention 10 is used to conceal a rigid suspension member 26, such as a down rod or support stem, as shown in FIG. 2, the free edge of each bracing panel 24 abuts the suspension member exterior.

In keeping with the objectives of the present invention, the device 10 may also be used with flexible suspension members 26', such as a cable or chain, as shown in FIG. 3. When engaging a flexible suspension member 26', compressible material 58 is used to provide increased contact surface area between the device 10 and the suspension member 26'. In a preferred embodiment, contoured blocks of compressible material 58, such as foam rubber, are inserted into each sleeve portion 12,14 and wedged between the bracing panels 24. Although other arrangements will suffice, the compressible material 26 will preferably rest both against the sleeve portion interior surfaces 31,33 and against the suspension member 26'. In this manner, the compressible material 58 will cooperate with the bracing panels 24 to hold the suspension member in place with respect to the sleeve portions 12,14. To ensure a snug fit, the present invention 10 also includes suspension member positioning plugs 60. In a preferred embodiment, as seen in FIG. 3, two slotted positioning plugs 60 keep the suspension member 26' centered with respect to the sleeve portions 12,14 the ceiling canopy 48, and the fixture main assembly 62, such as a fan or light. Although the positioning plugs 60 may be formed from a variety of materials, a compressible material, such as rubber is preferred.

The invention has been described in terms of specific embodiments. However, it will be readily apparent to those skilled in this art that various modifications, rearrangements and substitutions can be made without departing from the spirit of the invention. The scope of the invention is defined by the claims appended hereto.

What is claimed is:

1. A fixture decoration assembly for changing the appearance of ceiling-mounted fixture; said fixture having a ceiling canopy, a suspension member, and a main assembly; said decoration assembly comprising:

a first sleeve portion having a first end spaced apart from a second end by a contoured side wall extending therebetween, said first sleeve portion having an exterior surface and an interior surface, said exterior surface being characterized by at least one cutting guide;

a second sleeve portion having a first end spaced apart from a second end by a contoured side wall extending therebetween, said second sleeve portion having an exterior surface and an interior surface, said exterior surface being characterized by at least one cutting guide;

connection means for selectively joining said first and second sleeve portions in a use orientation; and internal bracing means adapted for maintaining said suspension member in a preferred location between said sleeves in said use orientation.

2. The fixture decoration assembly of claim 1 wherein said bracing means includes at least one rigid panel extending from said interior surface of said first sleeve.

3. The fixture decoration assembly of claim 1 wherein said bracing means includes compressible material adapted to maintain said suspension member in a fixed location with respect to said sleeve portions.

4. The fixture decoration assembly of claim 1 wherein said first ends of said sleeve portions cooperatively form a canopy-covering cavity adapted to cover said ceiling canopy in said use orientation.

5. The fixture decoration assembly of claim 1 wherein said second ends of said sleeve portions are adapted to rest against said main assembly in said use orientation.

6. The fixture decoration assembly of claim 1 wherein said connection means includes:

at least one fastening post extending from said first sleeve portion; and at least one post aperture adapted to releasably engage said at least one fastening post.

7. The fixture decoration assembly of claim 6, wherein said at least one fastening post is resiliently-compressible.

* * * * *